US006910315B2

(12) United States Patent
Suolahti

(10) Patent No.: US 6,910,315 B2
(45) Date of Patent: Jun. 28, 2005

(54) WRAPPING MACHINE AND METHOD FOR WRAPPING A WRAPPING FILM AROUND AN OBJECT

(75) Inventor: Yrjö Suolahti, Masku (FI)

(73) Assignee: Oy M. Haloila AB, Masku (FI)

( * ) Notice: Subject to any disclaimer, the term of this patent is extended or adjusted under 35 U.S.C. 154(b) by 11 days.

(21) Appl. No.: 10/667,514

(22) Filed: Sep. 23, 2003

(65) Prior Publication Data

US 2004/0055252 A1 Mar. 25, 2004

(30) Foreign Application Priority Data

Sep. 25, 2002 (FI) ..... 20021713

(51) Int. Cl.[7] ..... B65B 41/00

(52) U.S. Cl. ..... 53/389.3; 53/389.2; 53/556; 53/203; 53/265; 53/170; 53/176; 53/399

(58) Field of Search ..... 53/556, 203, 265, 53/170, 176, 389.3, 389.2, 172, 399, 441, 442, 443, 449

(56) References Cited

U.S. PATENT DOCUMENTS 3,589,095 A * 6/1971 James et al. ..... 53/51
3,650,773 A * 3/1972 Bush et al. ..... 426/383
4,628,668 A * 12/1986 Wildmoser ..... 53/399
4,655,028 A * 4/1987 Silbernagel ..... 53/399
6,219,992 B1 * 4/2001 Maki-Rahkola et al. ... 53/135.3
6,305,145 B2 * 10/2001 Suolahti ..... 53/64
6,393,808 B1 5/2002 Kallner et al.
6,453,643 B1 * 9/2002 Buscherini et al. ..... 53/399
6,694,712 B2 * 2/2004 Suolahti ..... 53/588
6,748,718 B2 * 6/2004 Lancaster et al. ..... 53/64

* cited by examiner

*Primary Examiner*—Scott A. Smith
*Assistant Examiner*—Brian Nash
(74) *Attorney, Agent, or Firm*—Lowe Hauptman & Berner, LLP

(57) ABSTRACT

A wrapping machine has a film dispensing unit (1), which includes first supporting elements (2) and first deflecting elements ($\mathbf{5}^1 \ldots \mathbf{5}^{10}$) for a first wrapping film (4) and second supporting elements (6) and a second deflecting element (9) for a second wrapping film (8). The second deflecting element (9) is movable between a first position (I) and a second position (II) by an actuator (10). In the first position (I), the end of the second wrapping film (8) is in contact with the first wrapping film (4) to cause the wrapping films to adhere to each other during the wrapping process. In the second position (II), the second deflecting element (9) is at a distance from the first wrapping film (4) so that the second wrapping film (9) is clear of contact with and adhesion to the first wrapping film (4).

10 Claims, 3 Drawing Sheets

WRAPPING MACHINE AND METHOD FOR WRAPPING A WRAPPING FILM AROUND AN OBJECT

BACKGROUND OF THE INVENTION

Figure 1:
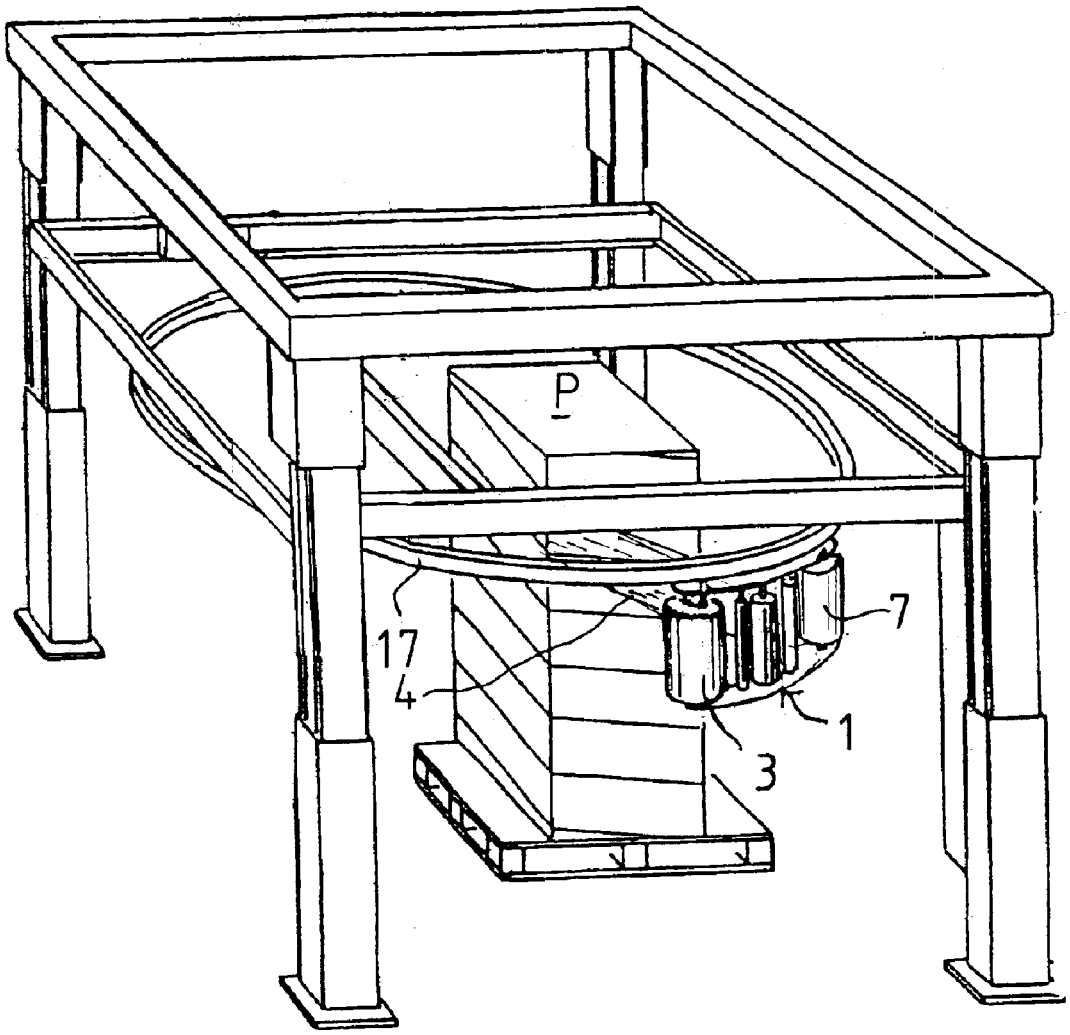

In prior art, a wrapping machine for wrapping a wrapping film around an object is known. The object is usually a load placed on a pallet. The wrapping machine comprises a film dispensing unit, which comprises supporting elements for rotatably supporting a wrapping film reel with a web of first wrapping film reeled up on it on the film dispensing unit. In addition, the film dispensing unit has deflecting elements, over which the first wrapping film unreeled from the first wrapping film reel can be passed to the object to be wrapped. From a film dispensing unit of this type, only one sort of wrapping film can be wrapped around the object at a time.

A problem with prior-art wrapping machines is that they cannot form any readily visible symbols, such as company emblems, logos, trademarks, patterns or the like, on the object to be wrapped during the wrapping process. If such symbols were printed on the actual wrapping film used to wrap the object, then the readability of the symbols would suffer because in a transparent film wrapped in several layers on the object there would be many symbols one over the other. Furthermore, as the film is usually passed through a pre-stretching device, the symbol is stretched and may become unreadable. Moreover, the use of expensive printed film for wrapping the whole object is uneconomical.

OBJECT OF THE INVENTION

The object of the present invention is to overcome the above-mentioned drawback.

A specific object of the invention is to disclose a wrapping machine and a system by means of which it will be easy to produce a visible symbol, such as a company emblem, logo, trademark, pattern or the like, on the object to be wrapped during the wrapping process.

A further object of the invention is to disclose a wrapping machine and method that will make it possible to wrap two different films simultaneously one over the other around the object.

BRIEF DESCRIPTION OF THE INVENTION

According to the invention, the wrapping machine comprises a film dispensing unit, which comprises first supporting elements for rotatably supporting on the film dispensing unit a first wrapping film reel containing a web of first wrapping film wound up on it. Further, the film dispensing unit comprises first deflecting elements, over which the first wrapping film unreeled from the first wrapping film reel can be passed to the object to be wrapped.

According to the invention, the film dispensing unit comprises second supporting elements for rotatably supporting on the film dispensing unit a second wrapping film reel containing a web of second wrapping film wound up on it. In addition, the film dispensing unit comprises a second deflecting element, over which the second wrapping film unreeled from the second wrapping film reel can be passed. The second deflecting element is mounted on the film dispensing unit so as to be movable between two positions. In a first position (I) of the second film dispensing unit, the end of the second wrapping film is in contact with the first wrapping film to cause the first and second wrapping films to adhere to each other during the wrapping process in order to bring them one over the other onto the object to be wrapped. In a second position of the second film dispensing unit, the second deflecting element is at a distance from the first wrapping film so that the second wrapping film is clear of contact with and adhesion to the first wrapping film. Moreover, the film dispensing unit comprises an actuator for moving the second deflecting element between the first position and the second position, and a severing device arranged to sever the second wrapping film at a point after the second deflecting element as seen in the direction of advance when the second deflecting element is being moved from the first position to the second position.

According to the invention, while the first wrapping film is being wrapped around the object, the second wrapping film is brought into contact with the moving first wrapping film, with the result that the second wrapping film sticks to the first wrapping film, which takes the second wrapping film with it; a predetermined amount of the second wrapping film and the first wrapping film are wrapped together around the object one over the other; the second wrapping film is severed when the predetermined amount of it has been wrapped; and the wrapping process is continued by wrapping the first wrapping film around the object, or the wrapping process is stopped.

The invention has the advantage that the second wrapping film may be different from the first wrapping film and it may be provided e.g. with a repeated symbol, such as a text, pattern, logo, trademark or the like, which can be made visible on the surface of the object during the wrapping process by delivering a suitable amount of it together with the actual first wrapping film. The symbol shines through the transparent first wrapping film and is easily detectable and visible.

In an embodiment of the wrapping machine, in the first position, the second deflecting element is arranged to be pressed against one of the first deflecting elements to form a nip between them. In the second position, the second deflecting element is at a distance from the first deflecting element.

In an embodiment of the wrapping machine, the film dispensing unit comprises a pendulum lever pivotally mounted on the film dispensing unit, to which pendulum lever the second deflecting element is connected. The actuator is arranged to turn the pendulum lever to move the second deflecting element between the first position and the second position.

In an embodiment of the wrapping machine, the severing device comprises a blade connected to the pendulum lever so as to be movable together with it, said blade being fitted to sever the second wrapping film when the second deflecting element is in the second position or close to it.

In an embodiment of the wrapping machine, the wrapping machine comprises a control device arranged to control the operation of the actuator and the severing device in such manner that, when an object is being wrapped, a predetermined amount of second wrapping film, said amount being substantially smaller than the total amount of first wrapping film to be wrapped around the object, can be applied to the object together with the first wrapping film.

In an embodiment of the wrapping machine, the predetermined amount of second wrapping film has been so chosen that it roughly corresponds to the amount required in one wrapping revolution.

In an embodiment of the wrapping machine, the second wrapping film is provided with a repeated text, pattern, mark or equivalent. The first wrapping film consists of transparent material so that the aforesaid text, pattern, mark or equivalent is visible on the object through the first wrapping film.

In an embodiment of the wrapping machine, the film dispensing unit comprises a pre-stretching device for pre-stretching the first wrapping film.

In an embodiment of the wrapping machine, the first deflecting elements comprise rollers rotatably mounted on the film dispensing unit.

In an embodiment of the wrapping machine, the second deflecting element is a roller rotatably mounted on the film dispensing unit.

LIST OF FIGURES

Figure 2:
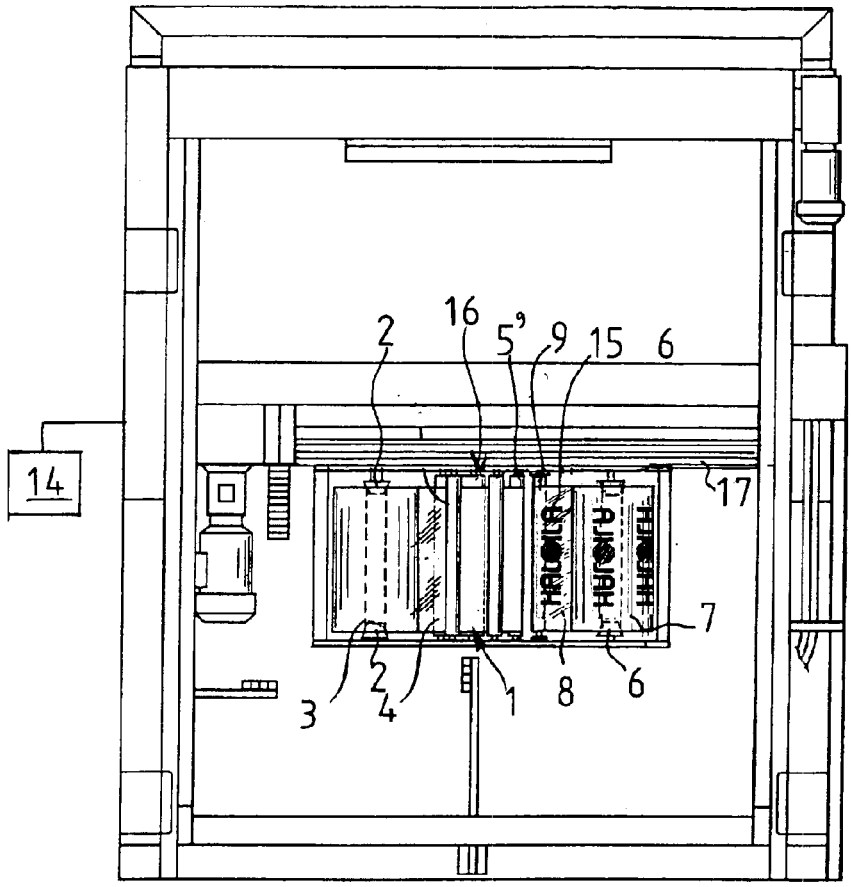
Figure 3:
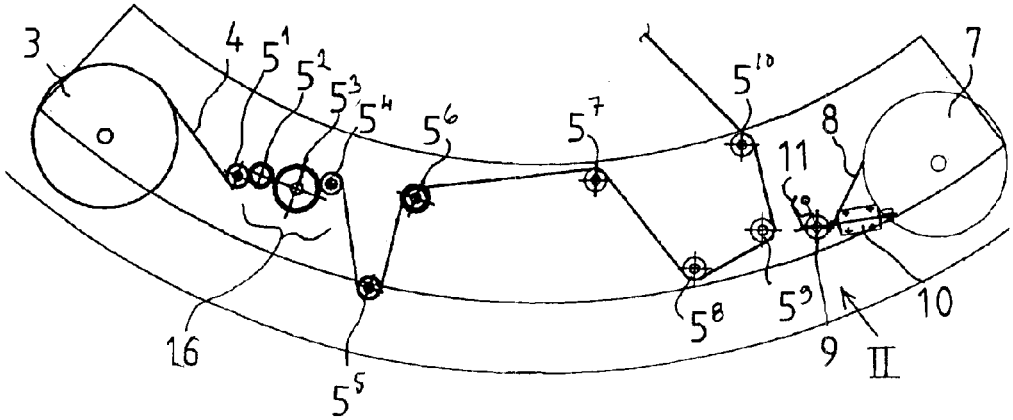
Figure 4:
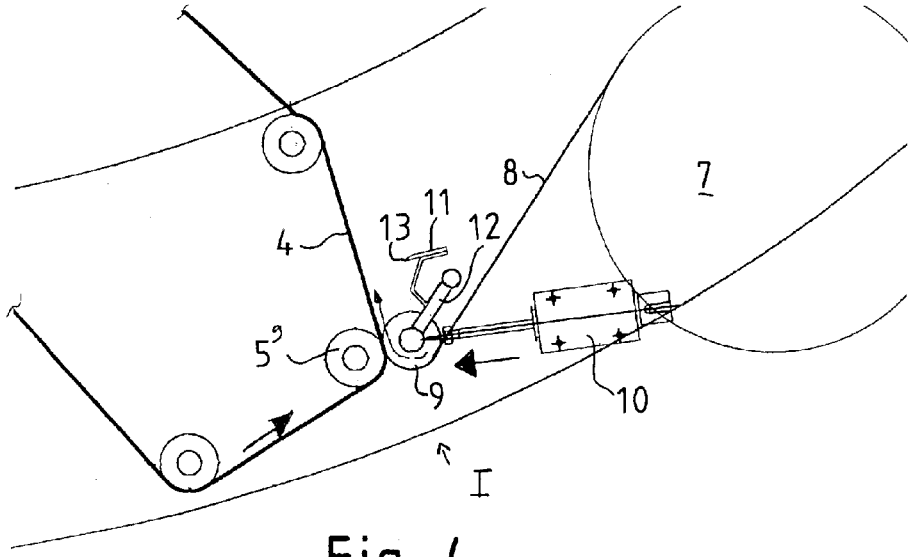
Figure 5:
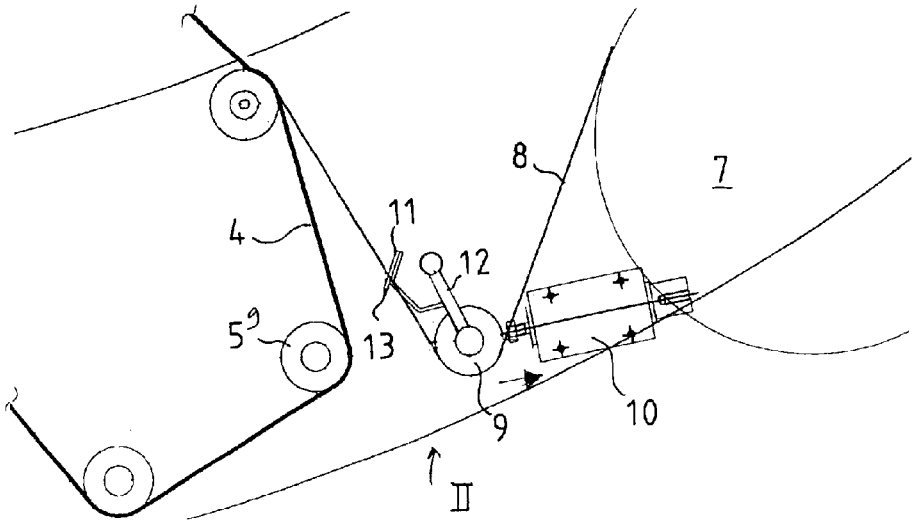

In the following, the invention will be described in detail by the aid of embodiment examples with reference to the attached drawings, wherein FIG. 1 presents an axonometric view of an embodiment of the wrapping machine of the invention as seen obliquely from above, FIG. 2 presents the wrapping machine of FIG. 1 in side view, FIG. 3 presents a diagrammatic top view of the film dispensing unit of the wrapping machine in FIGS. 1 and 2 in a first stage of the method of the invention, FIG. 4 presents a detail of the film dispensing unit in FIG. 3 in a second stage of the method of the invention, and FIG. 5 presents the film dispensing unit of FIG. 4 in a third stage of the method of the invention.

DETAILED DESCRIPTION OF THE INVENTION

FIG. 1 presents a wrapping machine intended for wrapping a wrapping film around a stationary object P to be wrapped. The object P may be e.g. an object having the shape of a parallelopiped, such as a pallet with a load on it.

The wrapping machine comprises a film dispensing unit 1, which has been arranged to revolve on a circular path at a constant speed around the object to be wrapped. In this embodiment, the path is formed by a circular guide ring 17, on which the film dispensing unit 1 is moved by a drive motor (not shown in the figure) provided in the film dispensing unit. The guide ring 17 is moved vertically during the wrapping process to allow a spiral wrapping to be formed on the object from the film.

It is to be noted that the film dispensing unit 1 described here can be applied in any wrapping machine, such as e.g. a machine in which the film dispensing unit is connected to a rotating crank carrying the film dispensing unit on an orbit around the object to be wrapped, or in a wrapping machine in which the film dispensing unit 1 is connected vertically movably to a fixed column and the film is drawn out and wound around an object being rotated.

FIG. 2 presents a more detailed view of the film dispensing unit 1, whose frame 18 is provided with first supporting elements 2 for detachably supporting a first wrapping film reel 3 on the frame 18. The supporting elements 2 consist of two support stocks which can be pushed into the central hole of the film reel 3 from either end of it to support the film reel. The supporting elements are mounted with bearings on the frame 18 so as to be freely rotatable, so that the film reel 3 supported by them can rotate freely.

As shown in FIG. 3, the film dispensing unit 1 comprises a number of first deflecting rollers $5^1 \ldots 5^{10}$, over and via which the first wrapping film 4 unreeled from the first wrapping film reel 3 can be passed to the object P to be wrapped. Some of the deflecting rollers $5^2 \ldots 5^4$ form a conventional pre-stretching device 16, in which a pre-stretching of the film occurs within the film portion between pre-stretching rollers as a result of different circumferential speeds of the of the pre-stretching rollers.

Further, the frame 18 of the film dispensing unit 1 is provided with second supporting elements 6 for detachably supporting a second wrapping film reel 7 on the frame 18. These supporting elements 6 consist of two support stocks which can be pushed into the central hole of the film reel 7 from either end of it to support the film reel. The supporting elements 6 are rotatably mounted with bearings on the frame 18 so that the film reel 7 can rotate while supported by them. The rotation of the supporting elements 6 can be slightly braked so as to produce a suitable low tension in the film.

The second wrapping film 8 is provided with a repeated printed text 15, pattern, mark or equivalent. The first wrapping film 4 is of a transparent or translucent material, so that the text 15, pattern, mark or equivalent on the second wrapping film 8 is visible on the object P through the first wrapping film 4.

Further, supported on the frame 18 of the film dispensing unit 1 is a second deflecting roller 9, over which the second wrapping film 8 unreeled from the second wrapping film reel 7 can be passed. The second deflecting roller 9 is a so-called pendulum roller, in other words, the second deflecting roller 9 is connected to a pendulum lever 12 pivotally mounted on the film dispensing unit. An actuator 10, such as a telescoping cylinder or equivalent, has been arranged to turn the pendulum lever 12 to move the second deflecting roller 9 between a first position I and a second position II.

In FIG. 4, the second deflecting roller 9 has been pushed by the actuator 10 into the first position I, where the end of the second wrapping film 8 has been brought into contact with the first wrapping film 4, so that the second wrapping film 8 can adhere to the first wrapping film 4. In the first position I, the second deflecting roller 9 is pressed against one of the first deflecting rollers $5^9$ so as to form a nip to bring about an adherence between the films 4 and 8. The films 4 and 8 sticking together are brought one over the other onto the object P to be wrapped.

In FIG. 5, the second deflecting roller 9 has been pulled by the actuator 10 to the second position II, where the second deflecting roller 9 is at a distance from the first deflecting roller $5^9$ and therefore from the first wrapping film 4, so that the second wrapping film 9 is clear of contact with and adhesion to the first wrapping film 4.

From FIG. 5 it can be seen how a severing device 11 severs the second wrapping film 8 after the second deflecting element 9 in the direction of film travel when the second deflecting element is moved from the first position I to the second position II. The severing device 11 comprises a blade 13 connected to the pendulum lever 12 so as to be movable together with it. The blade 13 has been fitted to cut the second wrapping film when the second deflecting element 9 is in position II or close to it.

To control the operation, the wrapping machine comprises a control device 14, which controls the operation of the actuator 10 and the severing device 11 in such manner that, when an object is being wrapped, a predetermined amount of the second wrapping film 8 is applied to the object, which amount is substantially smaller than the total amount of the first wrapping film 4 to be wrapped around the object. Preferably only an amount of the second wrapping film is supplied that roughly corresponds to the amount required in one wrapping revolution.

According to the method, the wrapping machine is operated so that first an amount of the first wrapping film is wrapped in a normal manner around the object to be wrapped. Next, while the first wrapping film is being wrapped around the object, the second wrapping film, in a portion close to its end, is brought into contact with the moving first wrapping film, with the result that that the second wrapping film adheres to the first wrapping film. The first wrapping film takes the second wrapping film with it. A predetermined amount of the second wrapping film and the first wrapping film are wrapped together one over the other around the object. Then the second wrapping film is severed after the predetermined amount of it has been wrapped. The process is continued by further wrapping the first wrapping film around the object, or the wrapping process can be stopped.

The invention is not limited to the embodiment examples described above; instead, many variations are possible within the scope of the inventive concept defined in the claims.

What is claimed is:

1. Wrapping machine for wrapping a wrapping film around an object (P), said wrapping machine comprising a film dispensing unit (1), which comprises first supporting elements (2) for rotatably supporting on the film dispensing unit a first wrapping film reel (3) containing a web of first wrapping film (4) wound up on it, first deflecting elements ($\mathbf{5}^1 \ldots \mathbf{5}^{10}$) over which the first wrapping film unreeled from the first wrapping film reel can be passed to the object to be wrapped, characterized in that the film dispensing unit (1) comprises second supporting elements (6) for rotatably supporting on the film dispensing unit a second wrapping film reel (7) containing a web of second wrapping film (8) wound up on it, a second deflecting element (9), over which the second wrapping film (8) unreeled from the second wrapping film reel (7) can be passed, said second deflecting element being mounted on the film dispensing unit (1) so as to be movable between two positions (I, II), a first position (I), in which the end of the second wrapping film (8) is in contact with the first wrapping film (4) to cause the first and second wrapping films to adhere to each other during the wrapping process in order to bring them one over the other onto the object to be wrapped, and a second position (II), in which the second deflecting element (9) is at a distance from the first wrapping film (4) so that the second wrapping film (9) is clear of contact with and adhesion to the first wrapping film (4), an actuator (10) for moving the second deflecting element (9) between the first position (I) and the second position (II), and a severing device (11) arranged to sever the second wrapping film (8) at a point after the second deflecting element (9) as seen in the direction of advance when the second deflecting element is being moved from the first position (I) to the second position (II).

2. Wrapping machine according to claim 1, characterized in that, in the first position (I), the second deflecting element (9) is arranged to be pressed against one of the first deflecting elements ($\mathbf{5}^9$) to form a nip between them, and that, in the second position (II), the second deflecting element (9) is at a distance from the first deflecting element ($\mathbf{5}^9$).

3. Wrapping machine according to claim 1, characterized in that the film dispensing unit (1) comprises a pendulum lever (12) pivotally mounted on the film dispensing unit, to which pendulum lever the second deflecting element (9) is connected; and that the actuator (10) is arranged to turn the pendulum lever to move the second deflecting element between the first position (I) and the second position (II).

4. Wrapping machine according to claim 1, characterized in that the severing device (11) comprises a blade (13) connected to the pendulum lever (12) so as to be movable together with it, said blade being fitted to sever the second wrapping film when the second deflecting element (9) is in the second position (II) or close to it.

5. Wrapping machine according to claim 1, characterized in that the wrapping machine comprises a control device (14) arranged to control the operation of the actuator (10) and the severing device (11) in such manner that, when an object is being wrapped, a predetermined amount of second wrapping film (8), said amount being substantially smaller than the total amount of first wrapping film (4) to be wrapped around the object, is applied to the object together with the first wrapping film.

6. Wrapping machine according to claim 5, characterized in that the aforesaid predetermined amount of second wrapping film (8) has been so chosen that it roughly corresponds to the amount required in one wrapping revolution.

7. Wrapping machine according to claim 1, characterized in that the second wrapping film (8) is provided with a repeated text, pattern, mark or equivalent (15); and that the first wrapping film (4) consists of transparent material so that the aforesaid text, pattern, mark or equivalent is visible on the object through the first wrapping film.

8. Wrapping machine according to claim 1, characterized in that the film dispensing unit (1) comprises a pre-stretching device (16) for pre-stretching the first wrapping film (4).

9. Wrapping machine according to claim 1, characterized in that the first deflecting elements ($\mathbf{5}^1 \ldots \mathbf{5}^{10}$) comprise rollers rotatably mounted on the film dispensing unit.

10. Wrapping machine according to claim 1, characterized in that the second deflecting element (9) is a roller rotatably mounted on the film dispensing unit (1).

* * * * *